United States Patent [19]

Jung

[11] Patent Number: 4,953,245

[45] Date of Patent: Sep. 4, 1990

[54] DEVICE FOR MOVING PATIENTS WHO ARE CONFINED TO BED

[76] Inventor: Hans Jung, Dammstrasse 9, D-7052, Schwaikheim, Fed. Rep. of Germany

[21] Appl. No.: 446,079

[22] Filed: Dec. 5, 1989

[30] Foreign Application Priority Data

Jan. 25, 1989 [DE] Fed. Rep. of Germany ..... 3902027

[51] Int. Cl.[5] ..... A61G 1/02; A61G 7/06

[52] U.S. Cl. ..... 5/81 B; 5/63; 5/86

[58] Field of Search ..... 5/63, 81.2, 81 B, 83, 5/86

[56] References Cited

U.S. PATENT DOCUMENTS

| | | | |
|---|---|---|---|
| 2,512,160 | 6/1950 | Koenigkramer et al. | 5/81 R |
| 3,099,020 | 7/1963 | Garfield et al. | 5/81 B |
| 3,115,646 | 12/1963 | Lee | 5/81 R |
| 3,786,523 | 1/1974 | Sele | 5/81 B |
| 4,327,455 | 5/1982 | Sefton | 5/81 R |
| 4,858,261 | 8/1989 | Iura | 5/81 X |
| 4,873,732 | 10/1988 | Perez | 5/86 X |

FOREIGN PATENT DOCUMENTS

| | | |
|---|---|---|
| 2658649 | 12/1976 | Fed. Rep. of Germany . |
| 3500212 | 1/1985 | Fed. Rep. of Germany . |

*Primary Examiner*—Michael F. Trettel

*Attorney, Agent, or Firm*—Poms, Smith, Lande & Rose

[57] ABSTRACT

A device (10) for moving patients who are confined to bed comprises a travelling undercarriage which can be locked in place by means of a locking brake (84), a stretcher support (16) which can be adjusted vertically and laterally relative to the undercarriage (16) and a locking gear (90) for the stretcher support (16). In order to obtain a stabilizing system securing the arrangement against tilting, which is easy to operate, it is proposed to provide a solid block (14) carrying the said vertically adjustable stretcher support (16) which block is carried itself by at least one guide element (34, 36) extending transversely in the said undercarriage (12) in such a manner that it can be displaced in transverse direction between two lateral end positions, with the locking gear comprising stop means which is arranged at the block (14), which can be controlled from the said stretcher support (16) and engaged in recesses provided on the guide element (34, 36) for blocking the relative movement between the block (14) and the undercarriage (12).

12 Claims, 3 Drawing Sheets

DEVICE FOR MOVING PATIENTS WHO ARE CONFINED TO BED

The present invention relates to a device for moving patients who are confined to bed, comprising a travelling undercarriage which can be locked in place by means of a locking brake, a stretcher support which can be adjusted vertically and laterally relative to the undercarriage, and a locking gear for the stretcher support.

A device of this type for moving patients has been known, for example, from German Patent No. 2658649 issued on July 22, 1982, holder: Ohkawa, Hiroshi, Aichi.

Devices of this type serve for transferring patients who are confined to bed to a travelling stretcher, or for re-transferring a patient to a bed after he had been placed on such a stretcher.

Such devices, which are also known as patients' trolleys, comprise a travelling undercarriage which is moved close to the bed when a patient is to be moved. The stretcher support is then adjusted to a height approximately equal to the lying plane of the patient in his bed. The stretcher support can be displaced laterally, in a horizontal direction, relative to the undercarriage. For moving a patient, the stretcher is moved to a position as close as possible to the patient to be transferred so that the latter can be moved from the bed to the stretcher by a simple turning movement. Thereafter, the stretcher support, with the patient lying thereon, is displaced horizontally until the patient occupies a position centrally aligned above the undercarriage. A locking gear ensures that the stretcher support can be locked in its extreme positions.

In the case of the device mentioned at the outset, the supporting means carrying the vertically adjustable stretcher support cannot be displaced relative to the undercarriage. A frame, which likewise cannot be displaced relative to the undercarriage, carries the stretcher support which can be moved laterally and pushed outwardly of the frame, but this only in one direction. Further, the frame is provided with a relatively heavy-weight and complex belt transfer device which ensures that a patient, after having been moved on to the outermost lateral area of the stretcher support can be pulled into a central position on the stretcher support.

A device of this type exhibits an extremely complex design; it is awkward to operate and connected with the additional disadvantage that relatively heavy parts are arranged at a considerable height above the floor on which the device is supported. This provides the risk that the device may tilt laterally, with the stretcher in the laterally displaced position.

It is, therefore, intended in the case of such devices that the stretcher support comes to rest on the mattress of the patient's bed in its laterally displaced position. However, mattresses are normally soft and resilient so that the stretcher support will sink into the material of the mattress whereby the mattress cover, or the mattress itself, may be damaged. In addition, it is also very difficult in these cases to move the stretcher support, with the patient lying thereon, laterally away from the bed.

Moreover, it has been found that considerable masses have to be moved when displacing the stretcher support laterally, with the patient lying thereon, and due to the mass inertia this fact may create a considerable tilting risk when the stretcher is braked suddenly in one of its extreme positions, and may in addition give rise to a force causing a sudden movement of the patient in a direction away from the stretcher which may even, in extreme cases, lead to the patient falling off the stretcher.

Certain measures securing the device against tilting movements, including a retractable foot arranged beneath the undercarriage, have been known from German Disclosure Document P 35 00 212, date of disclosure: 25.07.1985, applicant: UNISKA AG. However, such stabilizing means are rather complex, as regards their design, troublesome to operate, and can be used only where sufficient space is available beneath the patient's bed to permit the supporting foot to be extended laterally.

Now, it is the object of the present invention to provide a device of the type described at the outset which is simple to operate and safe, in particular safe against tilting.

This object is achieved according to the invention by the fact that a solid block carrying the vertically adjustable stretcher support is carried itself by at least one guide element extending transversely in the undercarriage in such a manner that it can be displaced in transverse direction between two lateral end positions, and that the locking gear comprises stop means arranged at the block, which can be controlled from the stretcher support and engaged in recesses provided on the guide element for blocking the relative movement of the block.

By providing the mass of a solid block in the undercarriage, the center of gravity of the device is moved relatively close to the floor so that the mass of a person lying on the stretcher support will no longer give rise to a tilting moment when the support is in its laterally displaced position. The block can be displaced in the transverse direction between two lateral end positions which are located inside the points where the undercarriage is supported on the floor. Contrary to the devices of the prior art, the stretcher support as such cannot be displaced laterally relative to the block: instead, its lateral movement is achieved by lateral displacement of the assembly comprising the block and the stretcher support. This does away with the necessity to arrange relatively heavy-weight frames at the level of the stretcher support from which the support as such can then be pulled out in lateral direction. Consequently, the stretcher support as such can now be given a relatively light-weight design, which means that the center of gravity of the mass can be placed as close as possible to the floor in order to exclude any tilting risk. The lateral travel of the block is sufficient to bring the stretcher support into a position directly adjacent the patient's lying plane. It is no longer necessary in this case to have the support rest on the mattress of the patient's bed. The patient is rolled from the lying surface of his bed on to the stretcher support by a lateral rolling movement, without any need for the attending person to lift the patient. Even in the case of heavy-weight patients any tilting risk is absolutely excluded due to the low position of the center of gravity and the correspondingly big mass of the block. Due to the fact that the locking gear is arranged in the block area facing the floor, in the neighborhood of the guide elements, these components are also arranged at a point close to the floor and ensure that the considerable masses moving during any lateral displacement can be safely held in specific predetermined positions and secured against lateral movements. One thereby also excludes the risk of relative movements between the solid block and the undercarriage, for example when moving the device through narrow curves, with the patient lying thereon. The fact that the device and/or its locking gear can be controlled from the stretcher support makes its operation vary handy for the operator.

According to another advantageous embodiment of the invention, the block is carried by at least two guide rails, with at least one of them being provided with the recesses.

This feature offers the advantage that sturdy means of a particularly simple design are provided for guiding the block and for allowing a locking engagement between the block and the stretcher support connected therewith, and the undercarriage. A corresponding solid design of the guide rails, combined with the lowest possible arrangement of the rails in the undercarriage, provide a perfect lateral guide and ensure on the other hand that the center of gravity of the device is again located near the floor.

According to another advantageous embodiment of the invention, the guide rails exhibit a square cross-section and are arranged in such a manner that two diagonally opposite longitudinal edges thereof extend vertically above each other, and the recesses are disposed in the area of the upper longitudinal edge.

This feature provides the advantage that the block can be guided on the two longitudinal surfaces arranged in the form of a roof and that the recesses can be worked into the guide rails, for example by a simple milling operation.

According to another advantageous embodiment of the invention, the recesses are approximately rectangular in shape, viewed from above, and provided with entry and exit slopes extending in the longitudinal direction of the guide rail.

This feature provides the advantage that the stop element can be engaged in, and detached from the recesses by a smooth movement so that jerks can be avoided. This helps reduce material wear and contributes, on the other hand, towards ensuring smooth braking of the movements.

According to another embodiment of the invention, the guide rail is chamfered in the area of its upper longitudinal edge.

This feature provides the advantage that the stop element is in contact with a relatively large area of the guide rail, before it enters the recesses, so that the friction forces encountered between these parts provide a braking effect as long as the stop element moves along the guide rail between two recesses.

A particularly advantageous embodiment of the invention provides that the stop element comprises a pin which can be retracted from the recesses against the action of a spring, which is accommodated in a housing together with the spring, and which can be moved by means of a lever arrangement that can be operated from the stretcher support.

This feature provides the advantage that once the stop element has been moved out of the recess, by an operator actuating the mechanism from the stretcher support, and once the stretcher support has been displaced laterally and the lever arrangement has been released, the stop element is urged upon the guide rail by the force of the spring so that a braking effect is produced by the frictional forces. When the next recess is reached, the stop element is then introduced into the latter by the force of the spring, whereby any further movement is blocked. By actuating the lever arrangement once more, it is then possible to disengage the stop element again from the recess and to displace the block, together with the stretcher support, once more laterally until the stop element comes to engage another recess. This makes it impossible for the block, together with the stretcher support, to be accelerated when the stop element is removed from the recess and released for a longer travel so that any risk of sudden movements of the patient during the braking phases is likewise excluded.

According to another advantageous embodiment of the invention, a lever which is connected with the spring-loaded pin via a cable pull is provided on each of the opposite transverse edges, viewed in the longitudinal direction of the stretcher support, in the bottom area of the stretcher support.

This feature provides the advantage that an operator gripping the upside of the stretcher support, in the area of the levers, may release the locking gear by his fingers reaching below the bottom of the stretcher support. Thanks to the fact that two lever arrangements are provided on the front and rear end of the stretcher support, respectively, the locking gear can be released by the operator regardless of his momentary position by the head or foot end of the stretcher.

According to another advantageous embodiment of the invention, the block is provided with an upright, U-shaped base body whose U members, which are arranged in a line in the longitudinal direction of the stretcher support, accommodate vertical guide rods running in bushes and being fixed to the bottom surface of the stretcher support.

This feature provides the advantage that the guiding and supporting means for the stretcher support exhibit a very simple design and have their center of gravity again very near the floor, i.e. in the area of the mass block. This guarantees that any tilting risk is safely excluded, even when the stretcher support is raised to its uppermost position.

According to another advantageous embodiment of the invention, a piston-and-cylinder unit is accommodated centrally in the U-shaped base body and the lifting piston, which is fixed to the bottom surface of the stretcher support, can be controlled via a pumping lever projecting from the undercarriage.

This feature provides the advantage that the components required for the movement of the stretcher support in vertical direction are likewise arranged on the mass block, near the floor, so that they also contribute towards creating a low center of gravity. A corresponding symmetrical arrangement ensures that the force of the lifting piston acts exactly upon the center of the stretcher support which ensures that the forces are distributed symmetrically and evenly over the stretcher support during the lifting movement.

According to another advantageous embodiment of the invention, projections are provided in the transverse direction, on both sides of the base body, and a housing of the locking gear is accommodated in a threaded opening provided in one projection.

This feature provides the advantage that the locking gear is arranged at a very low point of the block, in the direct neighborhood of the guide rails, so that these components, too, are arranged on the block in a central position and as close as possible to the floor.

According to another advantageous embodiment of the invention, the bottom of the block is provided with transverse grooves of triangular cross-section, which are provided with recesses for accommodating rollers running on the two upper inclined surfaces of the guide rails.

This feature provides the advantage that the block, embracing the rollers in part, is safely guided by the latter so that a low-friction guide can be achieved for the components travelling in transverse direction in the undercarriage if the rollers are designed appropriately.

According to still another advantageous embodiment of the invention, a counterpart is provided which engages the block and the guide rail from below and whose upside is provided with transverse grooves of triangular cross-section which are provided with recesses for accommodating rollers running on the two lower inclined faces of the guide rails, the counterpart being fixed to the block.

This feature offers the advantage that a roller cage enclosing the guide rails is formed which is supported by four points of the guide rail. By giving the counterpart an appropriate solid design, it is possible to locate the center of gravity of the block, together with the stretcher support, even lower while ensuring at the same time perfect mounting and guiding of the block at the undercarriage.

It is understood that the features that have been described before and will be explained hereafter may be used not only in the described combinations, but also in any other combination, or individually, without leaving the scope and intent of the present invention.

Certain selected embodiments of the invention will now be described in more detail with reference to the drawing in which.

Figure 1:
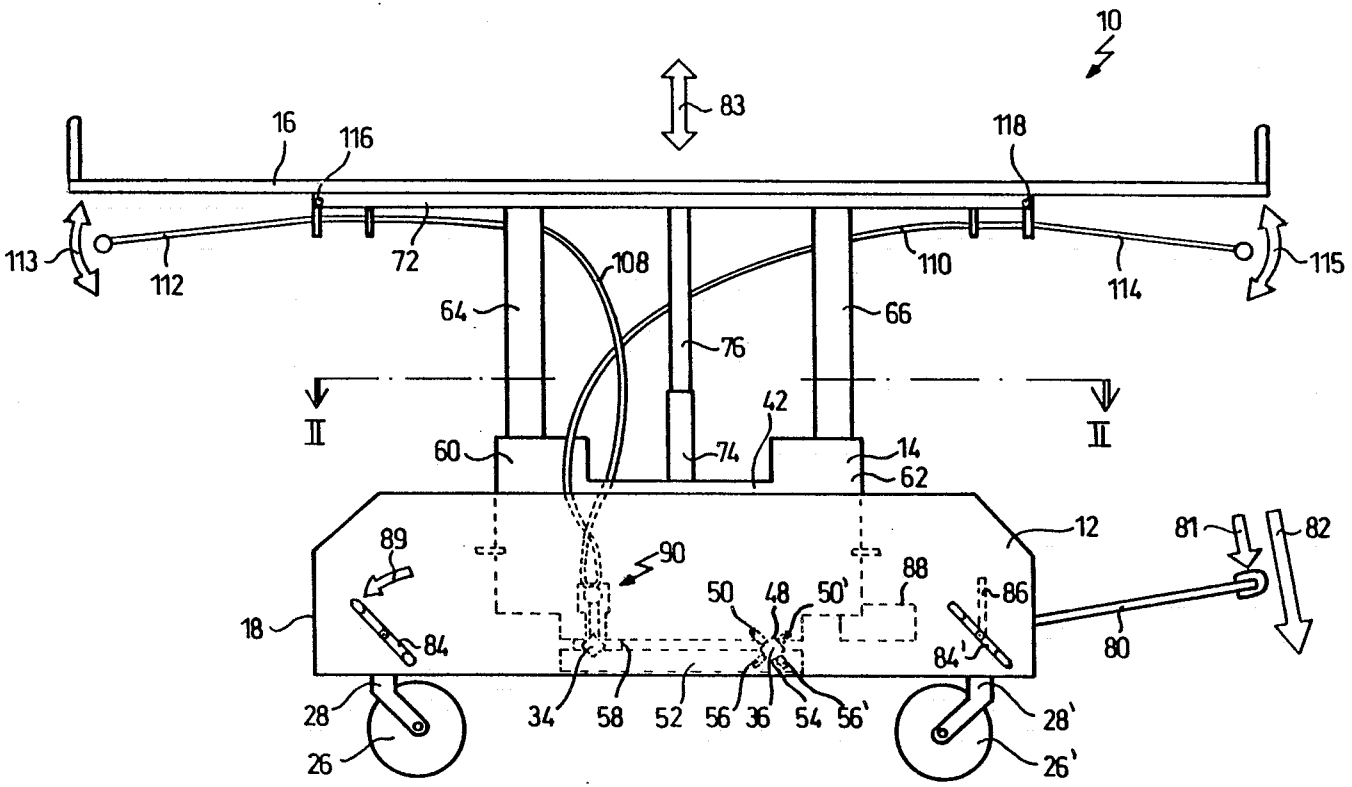
FIG. 1 shows a side view of the device according to the invention.
Figure 2:
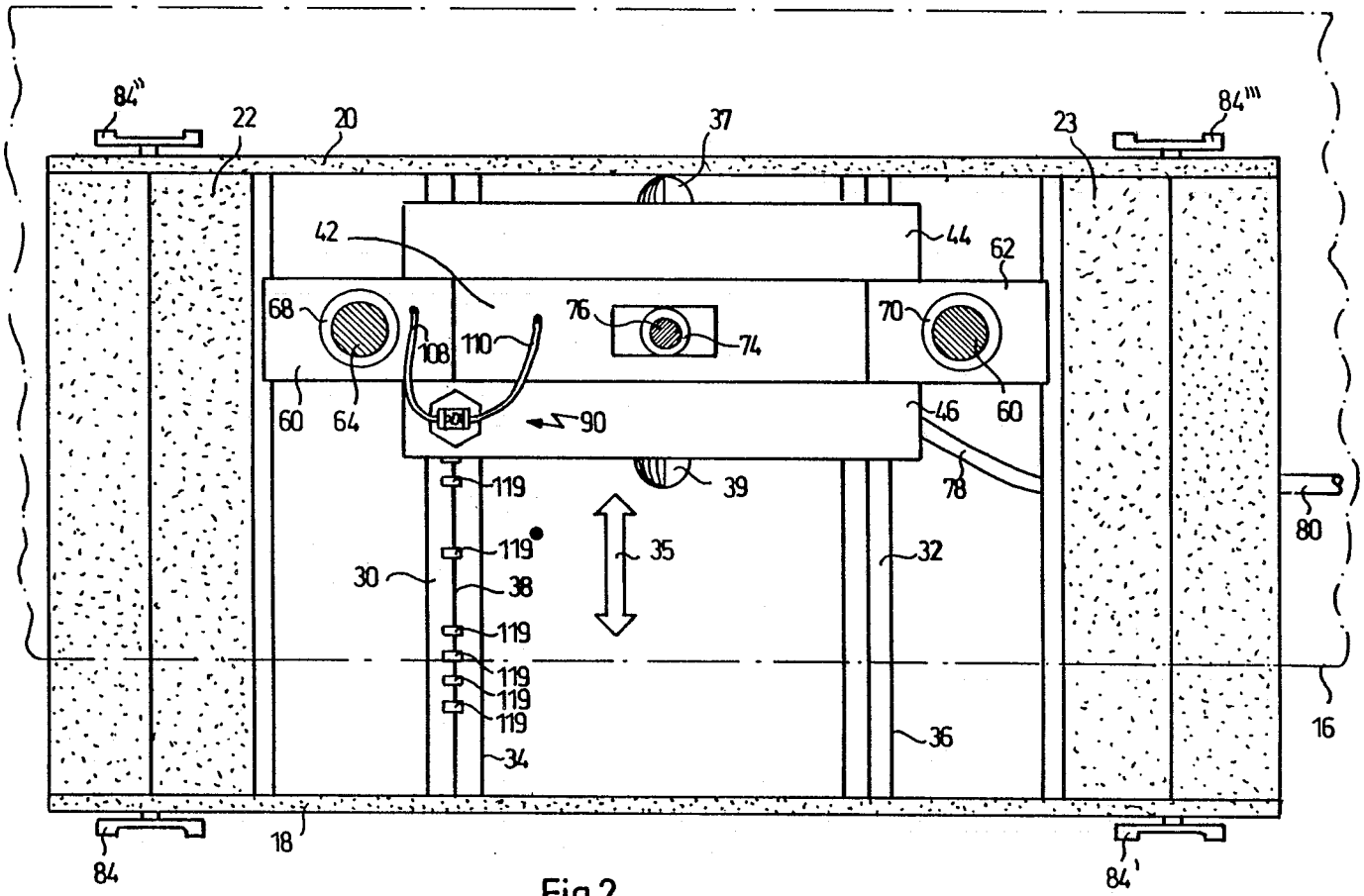
FIG. 2 shows a section along line II—II in FIG. 1.

The device 10 for moving patients who are confined to bed, as illustrated in FIGS. 1 and 2, comprises a travelling undercarriage 12 carrying a block 14 which can be displaced in transverse direction and which in turn carries a vertically adjustable stretcher support 16 fixed to the block.

The undercarriage 12 comprises two full-length side walls 18, 20 which are interconnected by transverse plates 22, 24 (see FIG. 2). The housing of the undercarriage 12 so formed is provided with a powder coating.

The bottom of the undercarriage 12 is equipped with four wheels 26, 26' . . . which are mounted to turn about vertical axle journals 28, 28' . . .

Between the two opposite side walls 18, 20, there extend through the undercarriage 12 two guide elements 30, 32 (see FIG. 2) consisting of guide rails 34, 36 of approximately square cross-section. The guide rail 34 (the same applies also to the guide rails 36) is arranged in such a manner that its upper longitudinal edge 38 comes to lie vertically above its lower longitudinal edge 40.

The block 14 comprises a U-shaped base body 42 (see in particular FIG. 1) which is formed integrally with projections 44, 46 provided on both sides, viewed in the transverse direction, i.e. in the longitudinal direction of the guide rail 34.

The block 14 consists of a cast aluminium body. It has a weight of approx. 50 Kg.

The bottom of the block 14 is provided with a transverse groove 48 of triangular cross-section (see in particular FIG. 1) which exhibits lateral recesses accommodating rollers 50, 50'. The groove 48 and the rollers 50, 50' are arranged in such a way that, when a block 14 is positioned on the guide rail, the rollers 50, 50' run on the roof-shaped inclined surfaces which are set off by an angle of 90°.

Another groove corresponding to the groove 48 is disposed at that point of the bottom of the block 14 where the latter rests on the guide rail 34. This groove, too, accommodates rollers (not shown in FIG. 1 for practical designing reasons) which likewise run on the upper roof-shaped surfaces of the guide rail 34.

A counterpart 52 arranged below the block 14 and extending below the guide rails 34 and 36 (see in particular FIGS. 1 and 3) is provided on its upside, in the area of the guide rail 36, with a matching groove 54 accommodating rollers 56, 56' in corresponding recesses.

Another groove is disposed in the area of the guide rails 34.

The counterpart 42 is connected with the bottom of the block 14 by means of mounting means 58 not shown in detail.

Consequently, the guide rails 34 and 36, together with the counterpart 42, are embraced by the block 14 in the manner of a roller cage, which permits a play-free and smooth sliding movement along the guide rails 34 and 36.

The U legs 60, 62 of the U-shaped base body 42 accommodate guide rods 64, 66 sliding in self-lubricating bushes 68, 70 and fixed to the bottom surface of a plate 72. The plate 72 carries the stretcher support 16 and is detachably connected with the latter.

In the case of the illustrated embodiment, the guide rods 64 and 66 (see FIG. 2) are designed as solid bars, but it is of course also possible to use hollow tubes in order to save weight.

Centrally between the U legs 60, 62, one can see a piston-and-cylinder unit 74 which is arranged in a full-height vertical opening in the U-shaped base body and whose piston 76 is connected with the bottom of the plate 72.

The piston-and-cylinder unit 74 is connected, via a hose 78 and a control unit not shown in detail, with a pumping lever 80 projecting from the transverse plate 23 of the undercarriage 12.

If the pumping lever 80 is pressed down by a given amount, as indicated by arrow 82 in FIG. 1, then the piston 76 is extended from the piston-and-cylinder unit 74 and the plate 72 is lifted, together with the stretcher support 16 (arrow 83). At the same time, the guide rods 64 and 66, respectively, are extended from the bushes 68 and 70.

When the pumping lever 80 is pressed down fully, as indicated by arrow 82 in FIG. 1, the piston 76 is lowered (arrow 83).

The undercarriage 12 can be locked in position, i.e. the wheels 26, 26' . . . can be blocked, by means of a locking mechanism of which only the locking levers 84, 84' . . . are shown in FIGS. 1 and 2.

The four locking levers 84, 84' . . . are interconnected in such a way that the locking brake is actuated if only one of the four locking levers 84, 84' . . . is operated.

In the position illustrated in FIG. 1, the locking levers 84, 84' occupy their locking positions.

For releasing the locking brake, the locking lever 84, for example, must be released, as indicated by arrow 89 in FIG. 1.

However, the locking brake of the undercarriage 12 can be released only if the block 14 occupies its central position, i.e. a position in which the stretcher support 16 does not project laterally beyond the undercarriage 12.

To this end, a blocking element 86 connected, for example, with the locking lever 84' can be pivoted by approx. 90° in counterclockwise direction only when a tongue 88 provided on the block 14 is in alignment with a matching groove in the blocking element 86. This is the case when the block 14 occupies the central position described before.

The projection 46 of the block 14 is provided with a threaded opening 94 which is disposed in the area above the upper longitudinal edge 38 of the guide rail 34 and which accommodates a housing 92 of a locking gear 90.

The hollow-cylindrical housing 92 seats a pin 96 comprising a first upper cylindrical portion 98 extending through an opening in the cover side of the housing 92.

The first cylindrical portion 98 is followed at its downward end by a second cylindrical portion 100 of larger diameter which ends by a tapering portion 102 extending away from the bottom of the housing 92 and, accordingly, from the bottom of the portion 46 of the block 14.

A biased compression spring 104 arranged in the space between the annular shoulder formed by the transition between the cylindrical portion 100 of larger diameter and the cylindrical portion 98 of smaller diameter, and the annular area on the inside of the housing 92 surrounding the passage opening for the first cylindrical portion 98 has the tendency to urge the pin 96 out of the housing 92.

The upper end of the pin 96 is connected with holding means 106 which is fixed to outer ends of two cable pulls 108 and 110.

The cable pull 108 (see also FIG. 1) is connected with a lever 112 which is arranged at the bottom face of the stretcher support 16 and pivoted on the plate 72 by a pivot axis 116.

Similarly, the cable pull 110 is connected with a diametrically opposite lever 114 which is pivoted on the plate 72 by a pivot axis 118. Now, if the lever 112, or the lever 114, is moved towards the bottom face of the stretcher support 16, the pin 96 is lifted—as viewed in FIG. 3—and the tapering portion 102 is pulled into the housing 92.

Figure 3:
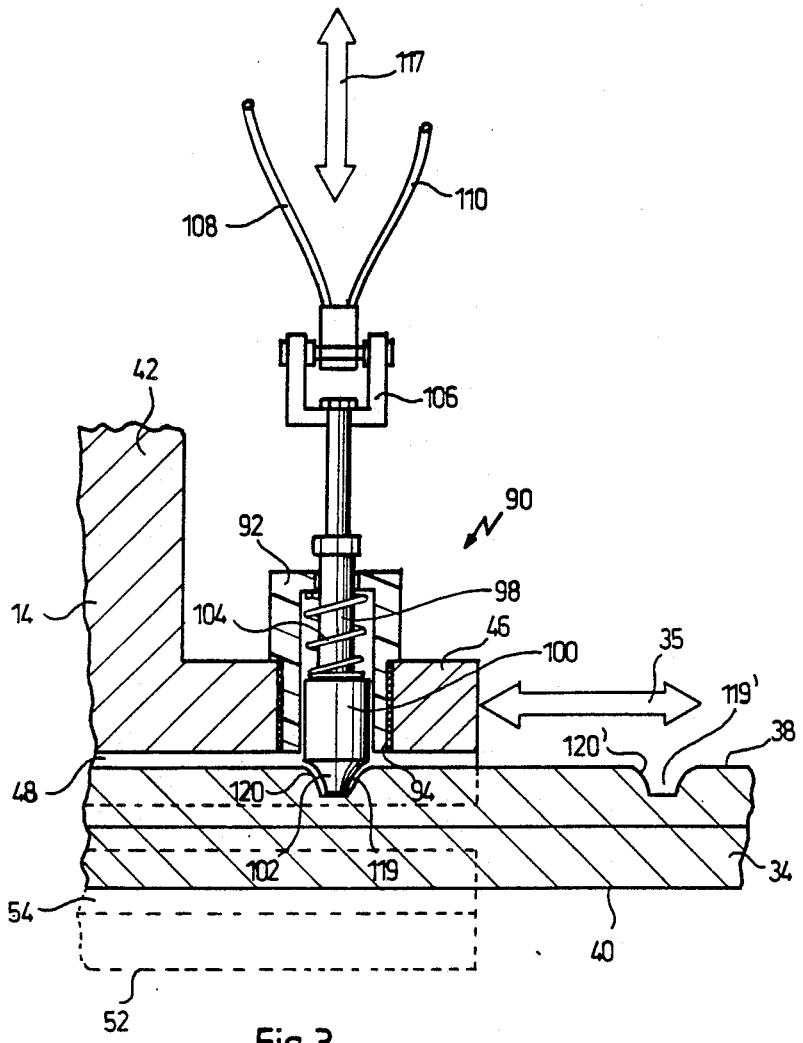
FIG. 3 shows a sectional view of a locking gear of a device according to the invention.

The upside of the guide rail 34 exhibits a plurality of recesses 119, 119' . . . of substantially rectangular cross-section, as viewed from the top (see FIG. 2), which are provided with entry and exit slopes 120 extending in the longitudinal direction of the guide rail 34, as can be seen best in FIG. 3.

The contour of the entry and exit slopes 120, 120' . . . is matched to the contour of the tapering portion 102 of the pin 96.

In the position shown in FIG. 3, the tapering portion 102 of the pin 96 is in engagement with a recess 119 so that the movement of the block 14 along the guide rails 34, 36, as indicated by arrow 35 in FIGS. 2 and 3, is blocked.

If one of the levers 112 or 114 is moved against the bottom surface of the stretcher support 16, the latter can be displaced laterally, together with the block 14. Once the lever 112 or 114, respectively, is released again it is moved away from the bottom of the stretcher support 16, under the action of the spring 104, as indicated by arrows 113 and 115, respectively, in FIG. 4.

When, for example, the pin 96 is positioned between the recesses 119 and 119' (FIG. 3), then the bottom of the tapering portion 102 is urged against the upper longitudinal edge 38 of the guide rail 34 under the action of the spring 104. This already produces a braking effect so that the block 14, together with the stretcher support 16 and the patient lying thereon, if any, cannot be accelerated excessively in transverse direction.

In the case of other embodiments of the invention, which are not illustrated in the drawing, the upper longitudinal edge 38 is chamfered so that a relatively large contact surface is obtained between the guide rail and the bottom face of the pin 96.

When the pin 96 moves to the right, as viewed in FIG. 3, and approaches the recess 119', it is guided smoothly into the recess 119', once it has reached the entry slope 120', and thereafter any further movement is blocked.

A recess 119, which in FIG. 2 is designated by reference numeral 119*, corresponds to a central position of the block 14 in which, as mentioned before, the blocking element of the locking mechanism of the undercarriage 12 can come into engagement with the tongue 88 at the block 14 in such a way as to permit the undercarriage 12 to travel.

In the case of the embodiment described before, only one locking gear 90 coacting with the guide rail 34 is provided.

However, there may of course be provided another locking gear 90 of similar design coacting with the guide rail 36, which will then also be connected with the levers 112 and 114, respectively, so that both locking gears can be released simultaneously when either of the independent levers 112 or 114 is actuated.

The lateral movement of the block 14 is stopped by buffer elements 37, 39 getting into contact with the inner surface of the side walls 18, 20.

The heavy and solid design of the block and its arrangement near the bottom of the undercarriage 12 ensure that the device is safely prevented from tilting even when a person of heavy weight is lying on the extreme outer projecting edge of the stretcher support 16, with the latter extended to its extreme lateral position.

Consequently, there is no need to provide any additional retractable supporting devices or the like.

I claim:

1. Device for moving patients who are confined to bed, comprising a travelling undercarriage which can be locked in place by means of a locking brake, a stretcher support which can be adjusted vertically and laterally relative to the undercarriage, and a locking gear for the stretcher support, wherein a solid block carrying the said vertically adjustable stretcher support is carried itself by at least one guide element extending transversely of the said undercarriage in such a manner that the block can be displaced in a transverse direction between two lateral end positions, and that the said locking gear comprises stop means attached to the said block, said stop means can be controlled from the said stretcher support and engage recesses provided on the said guide element for blocking the relative movement of the said block.

2. Device according to claim 1, wherein said block is carried by at least two guide rails, with at least one of them being provided with the said recesses.

3. Device according to claim 2, wherein said guide rails exhibit a square cross-section and are arranged in such a manner that two diagonally opposite longitudinal edges thereof extend transversely with one vertically above the other, and that the said recesses are disposed in the area of the upper longitudinal edge of one guide rail.

4. Device according to claim 3, wherein said recesses are approximately rectangular in shape, viewed from above, and provided with entry and exit slopes extending in longitudinal direction of the said guide rail.

5. Device according to claim 4, wherein said guide rail is chamfered in the area of its upper longitudinal edge.

6. Device according to claim 1, wherein said stop means comprises a pin which can be retracted from the said recesses against the action of a spring, the pin accommodated in a housing together with the said spring, said pin can be moved by means of a lever arrangement that can be operated from the said stretcher support.

7. Device according to claim 6, wherein said lever is connected with said spring-loaded pin via a cable pull provided on opposite end edges of the said stretcher support, on a bottom surface of the stretcher support.

8. Device according to claim 1, wherein said block is provided with an upright, U-shaped base body whose upright members are arranged in a line in a longitudinal direction of the said stretcher support and which accommodate vertical guide rods running in bushes and being fixed to a bottom surface of the said stretcher support.

9. Device according to claim 8, wherein a piston-and-cylinder unit is accommodated centrally in the said U-shaped base body and that the lifting piston, which is fixed to the bottom surface of the said stretcher support, can be controlled via a pumping lever projection from the said undercarriage.

10. Device according to claim 9, wherein projections are provided on both sides of the said base body, viewed in a transverse direction, and that a housing of the said locking gear is accommodated in a threaded opening provided in one of said projections.

11. Device according to claim 10, wherein the bottom of said block is provided with transverse grooves of triangular cross-section, which are provided with recesses for accommodating rollers running on a pair of upper inclined surfaces of the said guide rail.

12. Device according to claim 11, wherein a counterpart is provided which engages the said block and the said guide rail from below and whose upside is provided with transverse grooves of triangular cross-section which are provided with recesses for accommodating rollers running on a pair of lower inclined faces of the said guide rail, the said counterpart being mounted on the said block.

* * * * *